United States Patent [19]

Bakewell et al.

[11] Patent Number: 4,683,175

[45] Date of Patent: Jul. 28, 1987

[54] PROCESS FOR PRODUCING BRASS-COATED STEEL WIRE FOR THE TIRE CORD APPLICATIONS

[75] Inventors: Frank W. Bakewell, Washington Township, Westmoreland County; Charles D. Stricker, Monroeville, both of Pa.

[73] Assignee: Associated Materials Incorporated, Dallas, Tex.

[21] Appl. No.: 792,173

[22] Filed: Oct. 25, 1985

Related U.S. Application Data

[63] Continuation of Ser. No. 540,658, Oct. 11, 1983, abandoned.

[51] Int. Cl.[4] ..... B32B 15/20

[52] U.S. Cl. ..... 428/677; 148/11.5 Q; 148/12 B; 428/375; 428/389; 428/379; 428/390; 57/902

[58] Field of Search ..... 428/677, 658, 607, 606, 428/625, 375, 379, 389; 152/359; 72/46, 47; 148/11.5 Q, 12 B; 57/902

[56] References Cited

U.S. PATENT DOCUMENTS

| | | | |
|---|---|---|---|
| 2,002,261 | 5/1935 | Domm . | |
| 2,563,113 | 8/1951 | Hindin et al. . | |
| 2,746,135 | 5/1956 | Harris | 428/625 X |
| 3,749,558 | 7/1973 | Dillenschneider . | |
| 3,762,883 | 10/1973 | Shepard et al. | 428/677 X |
| 3,961,740 | 6/1976 | Nakamoto et al. . | |
| 4,068,041 | 1/1978 | Swarts et al. | 428/625 |
| 4,143,209 | 3/1979 | Gerspacher | 428/625 X |
| 4,226,918 | 10/1980 | Friend | 428/625 X |
| 4,255,496 | 3/1981 | Haemers | 428/677 |
| 4,265,678 | 5/1981 | Hachisuka et al. | 148/12 B |
| 4,279,968 | 7/1981 | Ruscoe et al. | 428/677 |
| 4,446,198 | 5/1984 | Shemenski et al. | 428/625 |

FOREIGN PATENT DOCUMENTS 1174055 3/1957 France .

*Primary Examiner*—Lorraine T. Kendell

*Attorney, Agent, or Firm*—Hubbard, Thurman, Turner & Tucker

[57] ABSTRACT

A process for producing steel wire for tire cord includes providing a brass coating on the wire containing from about 54 to about 65% copper and from about 46 to about 35% zinc. The weight of the coating is within the range of from about 2.5 to about 13.0 grams per kilogram of wire. The coated wire is heated at a temperature of at least about 650° F. for a time sufficient to reduce the hardness of the coating to a range of 40 to 70 Rockwell B. The heat treated wire is then cold reduced to final thickness. The wire subjected to this treatment has significantly improved drawability and greater coating continuity. In another aspect, an improved steel wire product for tire cord applications is provided when the brass coating contains from about 54 to about 62% copper and from about 46 to about 38% zinc and the coating weight is within the range of from about 7.0 to about 13.0 grams per kilogram of wire. The wire having these harder coatings is subjected to the aforementioned heat treatment to enable it to be drawn to final size. The wire having such coating exhibits a pull-out force of at least about 150 new tons when it is embedded in certain rubber formulations, cured and then subjected to a steam aging test for an exposure of 48-hours.

15 Claims, 6 Drawing Figures

PROCESS FOR PRODUCING BRASS-COATED STEEL WIRE FOR THE TIRE CORD APPLICATIONS

This application is a continuation, of application Ser. No. 540,658, filed 10-11-83, now abandoned.

BACKGROUND OF THE INVENTION

The present invention relates to a process for producing brass-coated steel wire for tire cord having improved drawability and substantially continuous crack-free coating after drawing to the final wire thickness. This invention also relates to a steel wire product having improved aged adhesion characteristics in certain rubber formulations.

The manufacture of steel wire for tire cord presently involves brass-plating the wire at an intermediate process size to assist in drafting the wire to finished size. The coating also serves to protect the base metal from corrosion and provide the necessary cord-to-rubber adhesion properties. The composition and thickness of the brass coating applied, as well as its continuity after the wire is drawn to finish size, all contribute to the performance of the wire in the stranded cord and to meeting each tire manufacturer's quality requirements. These requirements include a high level of both initial and aged adhesion of the cord in the particular rubber formulation of each tire manufacturer.

The various specifications from the major tire manufacturers require the weight of the coating as applied to be within a range of from 3.0 to 6.5 grams per kilogram of wire, and the composition of the coating to be within the range of from 62 to 70% copper and 30 to 38% zinc. Attempts have been made to improve the adhesion under aged conditions by slightly decreasing the copper percentage in the coating as well as decreasing the coating thickness. However, decreasing the copper content is known to cause the wire to have poorer drawing properties. This in turn causes poorer coating continuity at final thickness and decreases corrosion resistance of the wire. It also shortens the life of dies used in drawing the wire. To counter this last-mentioned effect, it often becomes necessary to use expensive diamond dies in order to achieve reasonable production rates.

Prior work described in French Patent No. 1,174,055 indicates the desirability of heating wire after it is coated first with zinc and then copper in separate layers. The heat treatment causes diffusion in the layers so as to form a brass coating which is stated to be more suitable for drawing and results in good rubber-to-wire adhesion. However, this work teaches that the final coating composition must be in the alpha-brass range, i.e. preferably containing 64 to 75% copper and the balance zinc. The patent also teaches that heating at higher temperatures will drive off any excess zinc present and produce the desired alpha-brass coating composition. The patent states that this benefit cannot be obtained when "coplated" brass coatings are heated. The reference indicates that the only benefit to be gained by heating "coplated" brass-coated wire is for rehabilitation of such wire in the event that it has poor drawing properties even though the composition is within the desired alpha-brass composition range. There is no suggestion in the reference that wire coplated with brass, having a copper content lower than the alpha brass range, might be heat-treated in order to produce superior improved drawability and superior aged adhesion properties, nor that such treatment would provide a coating which would be substantially continuous and crack-free after the wire is drawn to finished size.

U.S. Pat. No. 3,749,558, Dillenschneider discloses steel tire wire coated with nickel, copper and zinc in separate layers. The wire is then heated at 450° C. for a few seconds to form a brass coating containing 70% copper. Also of interest is U.S. Pat. No. 2,563,113, Hindin et al which discloses steel tire cord wire plated with brass containing from 55–75% copper. This reference does not teach heat treatment of the coated wire. U.S. Pat. No. 3,961,740, Nakamoto et al discloses tire cord wire having a ternary coating containing 59–73% copper, 23–34% zinc, and 2–13% tin. U.S. Pat. No. 2,002,261, Domm discloses steel wire for tire bead applications, i.e. the wire is not cold-reduced after coating. The coating disclosed in this latter reference is a zinc layer weighing from 8 to 24 grams per kilogram of wire followed by a copper layer weighing 0.5 to 1.3 grams per kilogram of wire. The reference teaches that the layers diffuse upon vulcanization of the rubber article in which the wire is embedded so as to form an alloy coating. The proportion of zinc-to-copper in the layers is stated to be from 6 to 30 parts zinc for every one part of copper.

It is an object of the present invention to provide a process for treating brass-coated steel wire so as to significantly improve the drawability of the wire and provide a substantially continuous crack-free coating at final thickness.

It is another object of the invention to provide a brass-coated steel wire product made up of wire in stranded form having significantly improved aged adhesion properties in certain rubber formulations.

It is still another object of the invention to provide a process for producing steel tire cord wire by applying a coating having a composition within the range in which both alpha and beta phases are present under equilibrium conditions, and then heat-treating the wire to reduce the hardness of the coating to Rockwell B40-70 prior to drawing the wire to final thickness.

SUMMARY OF THE INVENTION

The process of the present invention includes applying a brass coating to steel wire at an intermediate process size. The coating as applied is of a composition consisting essentially of from about 54 to about 65% copper and from about 46 to about 35% zinc. The weight of the coating applied is within the range of from about 2.5 to about 13.0 grams per kilogram of said wire. After coating, the wire is then heat-treated at a temperature of at least about 650° F. for a time sufficient to achieve a coating hardness within the range of from about 40 to about 70 Rockwell B. The heat-treated wire is then drawn to a final thickness sufficient to provide at least about 60% reduction in the cross-sectional area of said wire. Preferably, the copper content of the coating is less than 62%, more preferably it is within the range of 56 to 60%. The temperature of the heating step preferably should be not more than 1000° F., more preferably it should be within the range of 700 to 900° F. The time of heating preferably should be at least 2-minutes in the latter temperature range, more preferably at least 5-minutes at such temperature so as to produce a coating hardness less than $R_B$60. Increased coating weights of from about 8.0 to about 12.0 grams of coating per kilogram of wire are more desirable, and most preferably should be within the range of 9.0 to 11.0 grams per kilogram of wire. In some rubber formulations, namely those of manufacturers A and B, a significant increase in aged adhesion properties is provided by applying brass coatings containing 54 to 62% copper and 46 to 38% zinc to the wire in weights within the range of from about 7.0 to about 13.0, preferably from about 9.0 to about 11.0 grams per kilogram of wire. The wire having such coatings is then heat-treated at a temperature and for a time sufficient to achieve a coating hardness of Rockwell B40-70 prior to drawing of the wire to final thickness.

DESCRIPTION OF THE PREFERRED EMBODIMENT

In order to determine the effect of heat-treatment on coating hardness, flat coupon samples having a brass coating were heat-treated and then cold-rolled to various thicknesses. The samples were coated on bench scale electroplating equipment. Plating was carried out for 4-hours at a current density of 60 amperes/square foot (646 A/m$^2$) using the electrolytes shown in Table I below:

TABLE I

SUMMARY OF PLATING ELECTROLYTES AND CORRESPONDING BRASS COATING COMPOSITIONS OBTAINED

| | BATH NO. 1 | BATH NO. 2 | BATH NO. 3 |
|---|---|---|---|
| ELECTROLYTE | | | |
| Zinc | 27.6 | 27.6 | 27.6 |
| Copper | 51.5 | 51.5 | 51.5 |
| Free Cynanide | 11.2 | 11.2 | 11.2 |
| pH | 11.2 | 12.0 | 12.7 |
| RESULTING BRASS COATING | | | |
| % Copper | 76–78 | 60–57 | 54–52 |
| % Zinc | 24–22 | 40–43 | 46–48 |

The bath temperature was maintained at 113 to 117? F. and coating thicknesses ranged between 8 and 10 mils. The composition of the coatings produced was varied by altering the pH of the electrolyte. At a pH of 11.2 the brass-coating contained 76% copper, at a pH of 11.8 the brass-coating contained 60% copper, and at a pH of 12.6 the coating contained 52% copper. Half of the coupons from each brass-coating composition were sealed in evacuated quartz tubes and heat-treated by holding for 2-hours at 1000° F. (538° C.) and air-cooling to room temperature. Both the as-plated and heat-treated coupons were then cold-rolled to provide full cross-sectional reductions of 20, 40, 60 and 80 percent. At each cold reduction level, a segment was cut from each coupon for hardness and microsection evaluations. The coatings evaluated included those shown by X-ray analysis to have compositions in the alpha-brass range (greater than 62% copper), the alpha-plus-beta brass range (62 to 54.5% copper), and the beta-brass range (54.5 to 50% copper). The hardness readings were determined by using a Reichert Micro-hardness Tester with a 16-gram load and with the indenter penetrating the cross-section of each coating. The hardness reading obtained were then converted from Vickers to Rockwell B values. Coating-continuity ratings were determined according to an arbitrary rating system in which a zero rating indicates a very porous coating with extensive pits, cracks, and voids, and a rating of 10 represents a continuous, pore-free coating.

Figure 1:
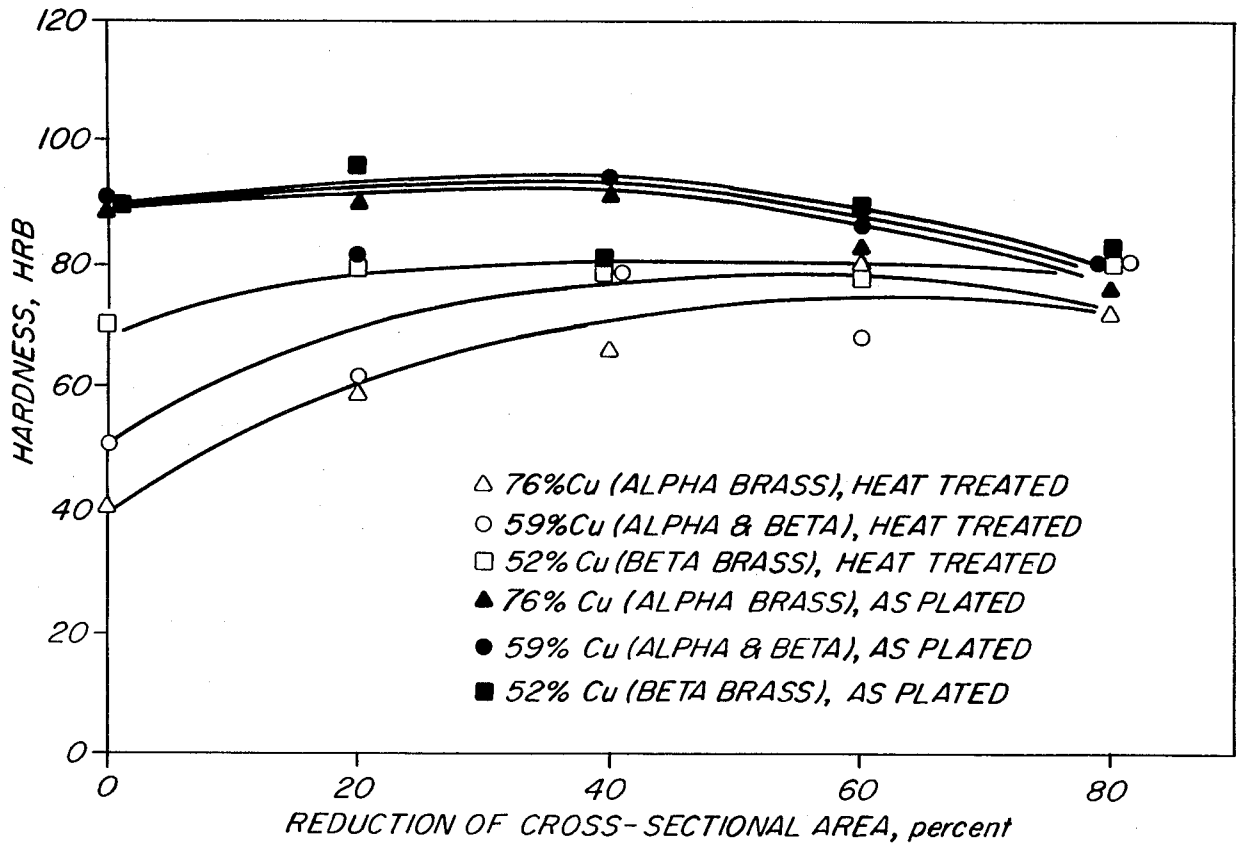
FIG. 1 is a graph showing the effect of cold rolling on the hardness of brass coatings with various copper contents in the as-plated and heat-treated conditions.

The effect of cold-rolling on the coating hardness of both the as-plated and heat-treated samples is shown in FIG. 1. FIG. 1 indicates that heating the coupons for 2-hours at 1000° F. substantially decreased the as-plated coating hardness, for example, from RB 88 to 40 for alpha-brass, from RB 90 to 50 for alpha-beta brass and RB 90 to 70 for beta-brass coatings. For each heat-treated coating composition, the hardness values gradually increased as the amount of cold work was increased but the maximum hardness was not reached even after cold-reductions of 80 percent. These results correlate very well with the coating continuity ratings discussed below.

Figure 2:
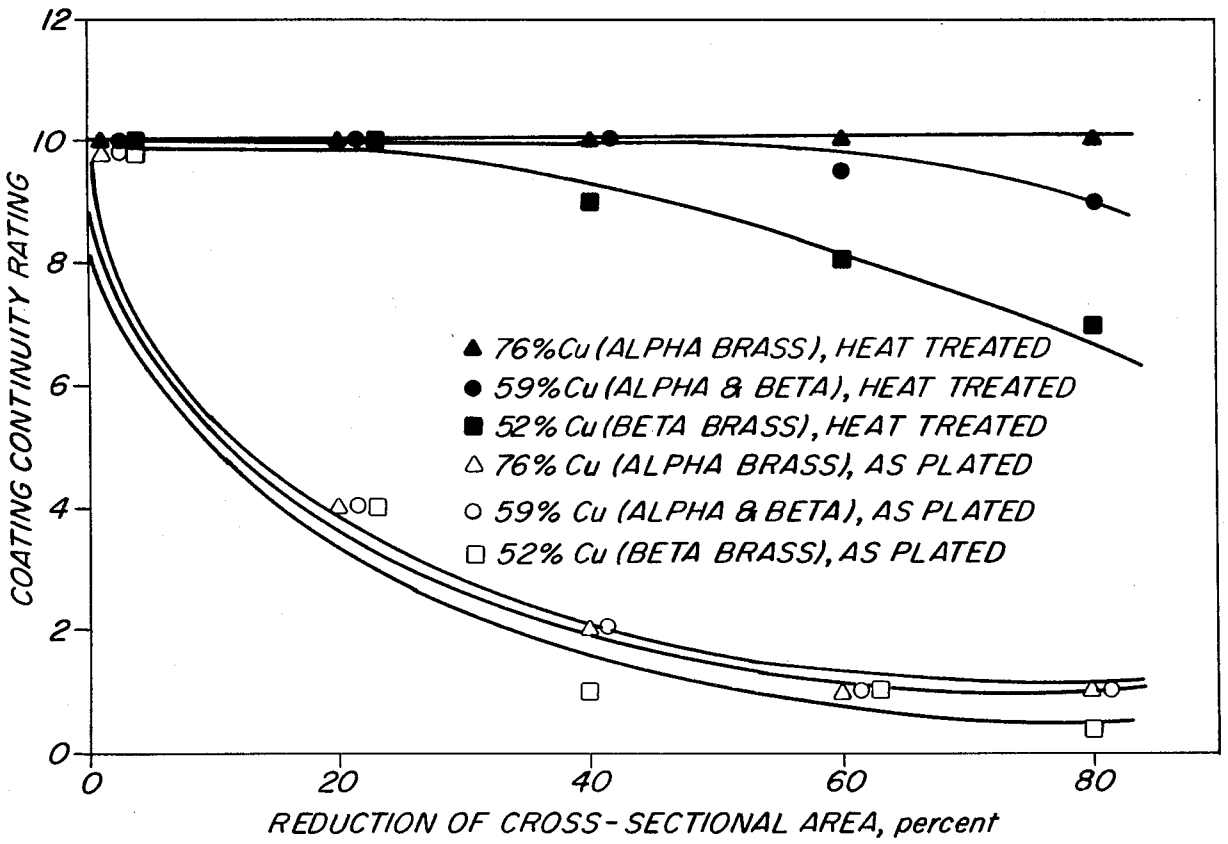
FIG. 2 is a graph showing evaluation of coating continuity ratings on brass coatings after varying amounts of cold rolling for brass coatings with various copper contents in the as-plated and heat-treated conditions.

FIG. 2 shows the results of coating continuity ratings after cold rolling the as-plated and heat-treated coupon samples for various reductions. Coating continuity ratings were determined by means of an arbitrary rating system in which a zero rating represents a very porous coating with extensive pits, cracks and voids and a 10 rating represents a continuous pore-free coating. For each of the as-plated coatings, regardless of composition, a rapid deterioration in coating continuity occurs with increasing cold reduction. Heat-treating the coatings for 2-hours at 1000° F. followed by air-cooling to room temperature almost completely eliminated the effect of cold work on coating continuity. For example, after cold-rolling 80%, the alpha-brass and alpha-plus-beta brass coatings remained essentially continuous and crack-free. Only the beta-brass coatings showed pitting and cracking after cold-rolling 80%, but these coatings showed considerably greater continuity than as-plated coatings cold-reduced only 20 percent.

Figure 3:
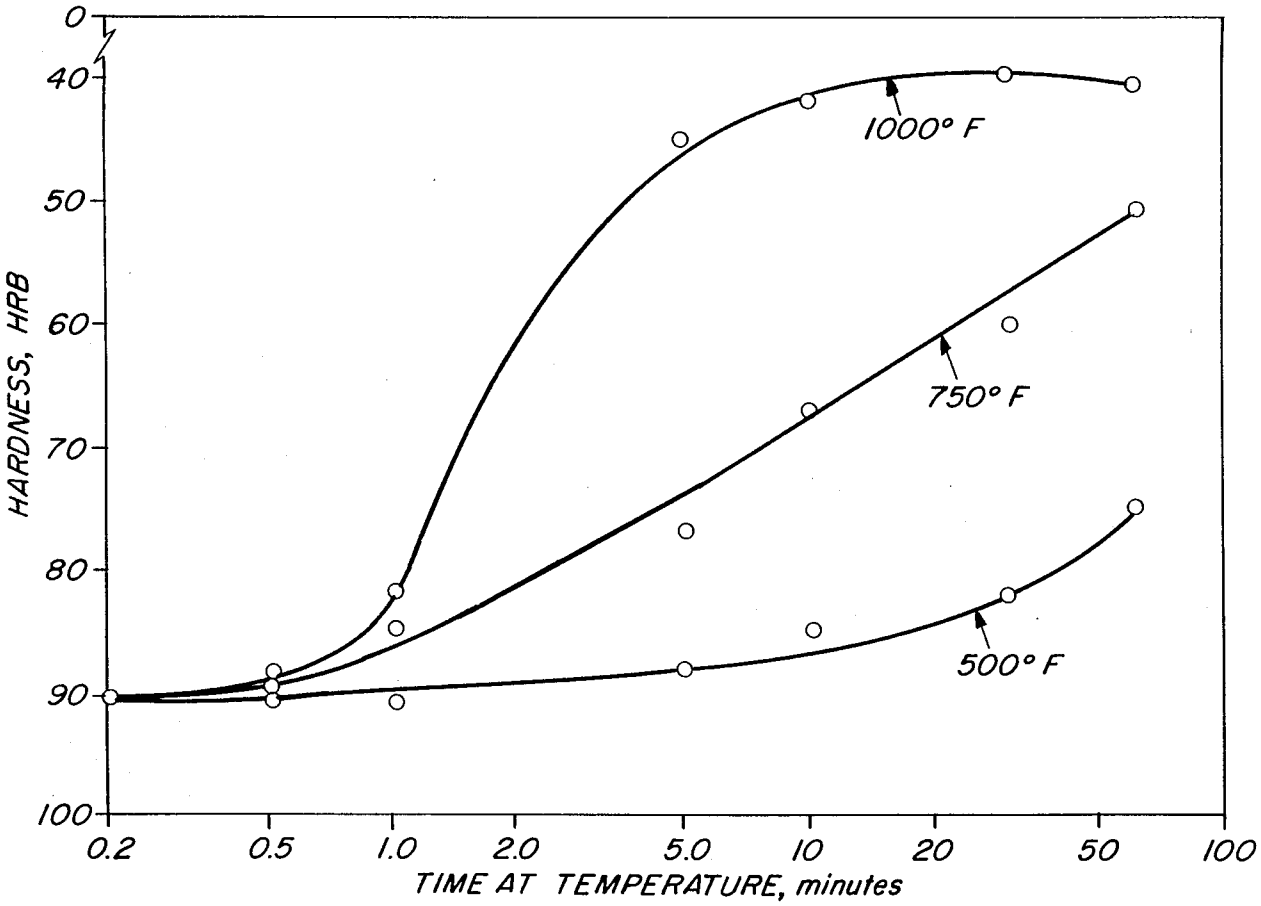
FIG. 3 is a graph showing the effect of heat-treating conditions on the hardness of electroplated brass coatings of alpha brass composition.
Figure 4:
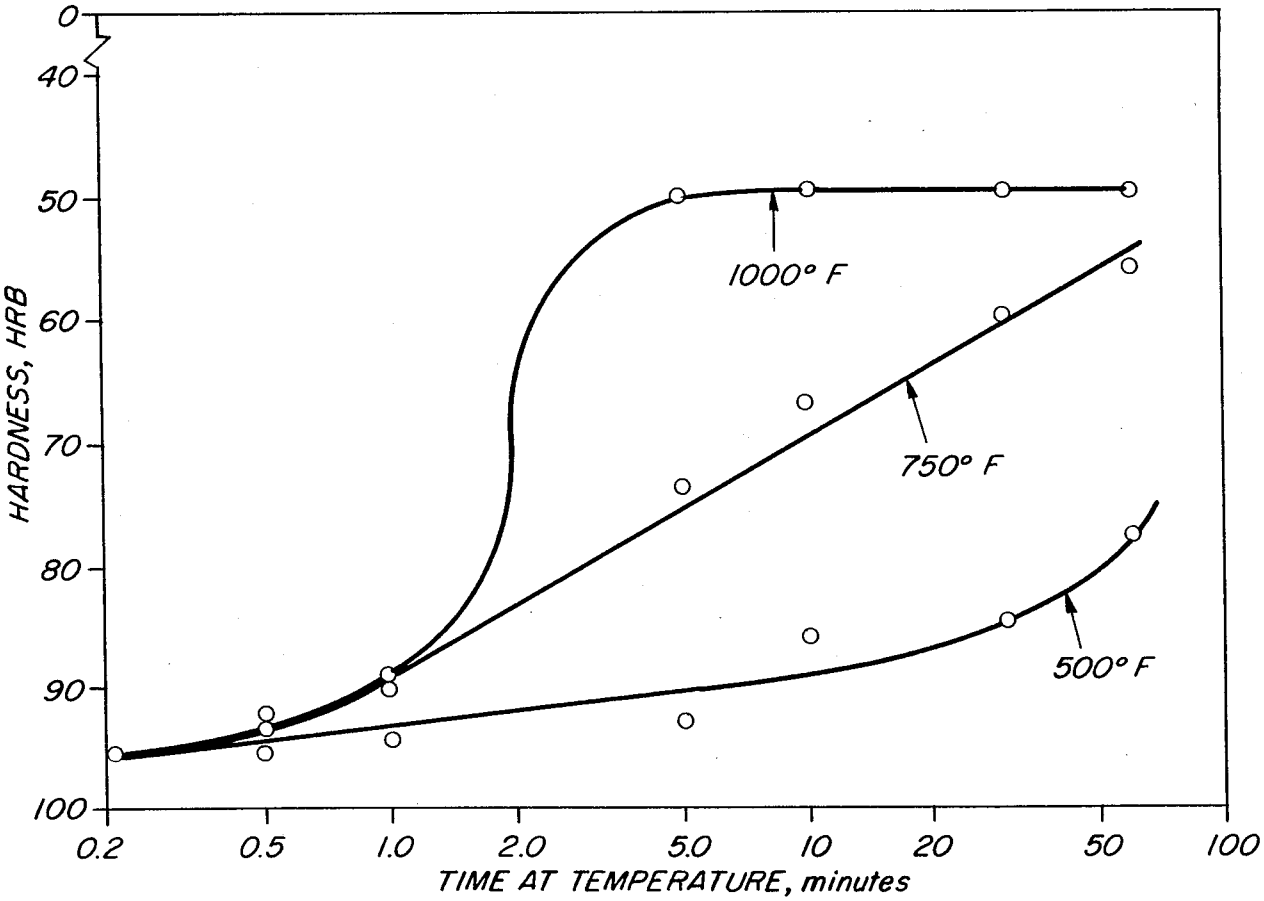
FIG. 4 is a graph showing the effect of heat-treating conditions on the hardness of electroplated brass coatings of alpha-beta brass compositions.
Figure 5:
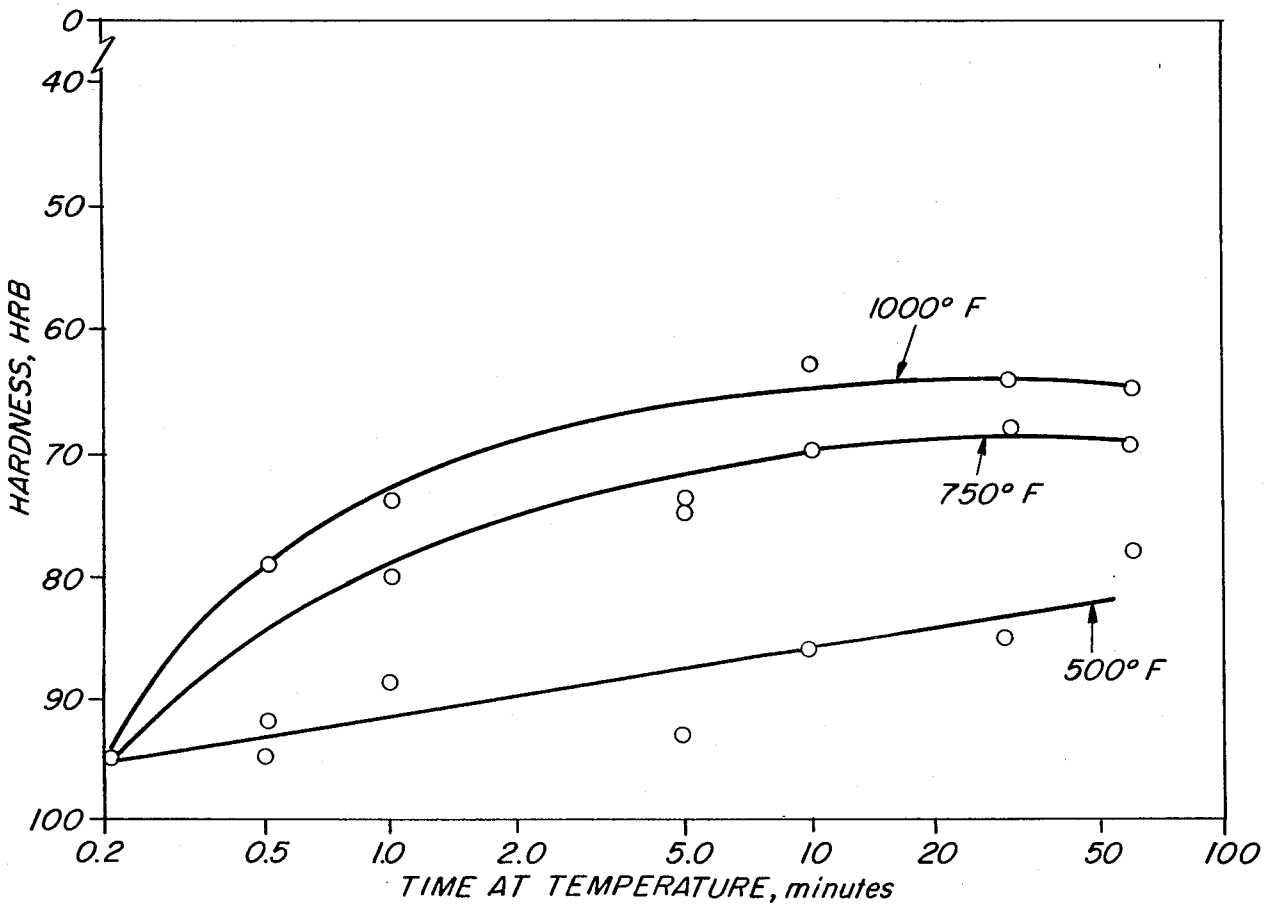
FIG. 5 is a graph showing the effect of heat-treating conditions on the hardness of electroplated brass coatings of beta brass composition.

Trials were also conducted on a pilot electroplating line on grade 1065 steel wire of 0.050-inch diameter using the electrolytes listed in Table I above. The wire was plated at a current density of 60A/sq. ft. at a line speed of 0.9 ft./min. to obtain approximately 2 mil. thick coatings. Bath temperature again was maintained at 113 to 117° F. and the coating compositions were varied by adjusting the pH of the electrolyte. At a pH of 11.2 the coating contained 68% copper, at a pH of 11.8 the coating contained 59% copper, and at a pH of 12.6 the coating contained 54% copper. The coated wire samples were heat-treated at 500° , 750° and 1000° F. for times ranging from 30-seconds to 1-hour. The same procedure for determining coating hardness was used as on the bench trial coupons. FIGS. 3, 4 and 5 show the results of various heat treatments on the hardness of the coatings. A time of at least 2-minutes at temperature, preferably 5-minutes, is needed to lower the hardness of the alpha-plus-beta brass coating to a level of about Rockwell B50. Longer times are needed at lower temperatures in order to achieve the desired hardness level.

Figure 6:
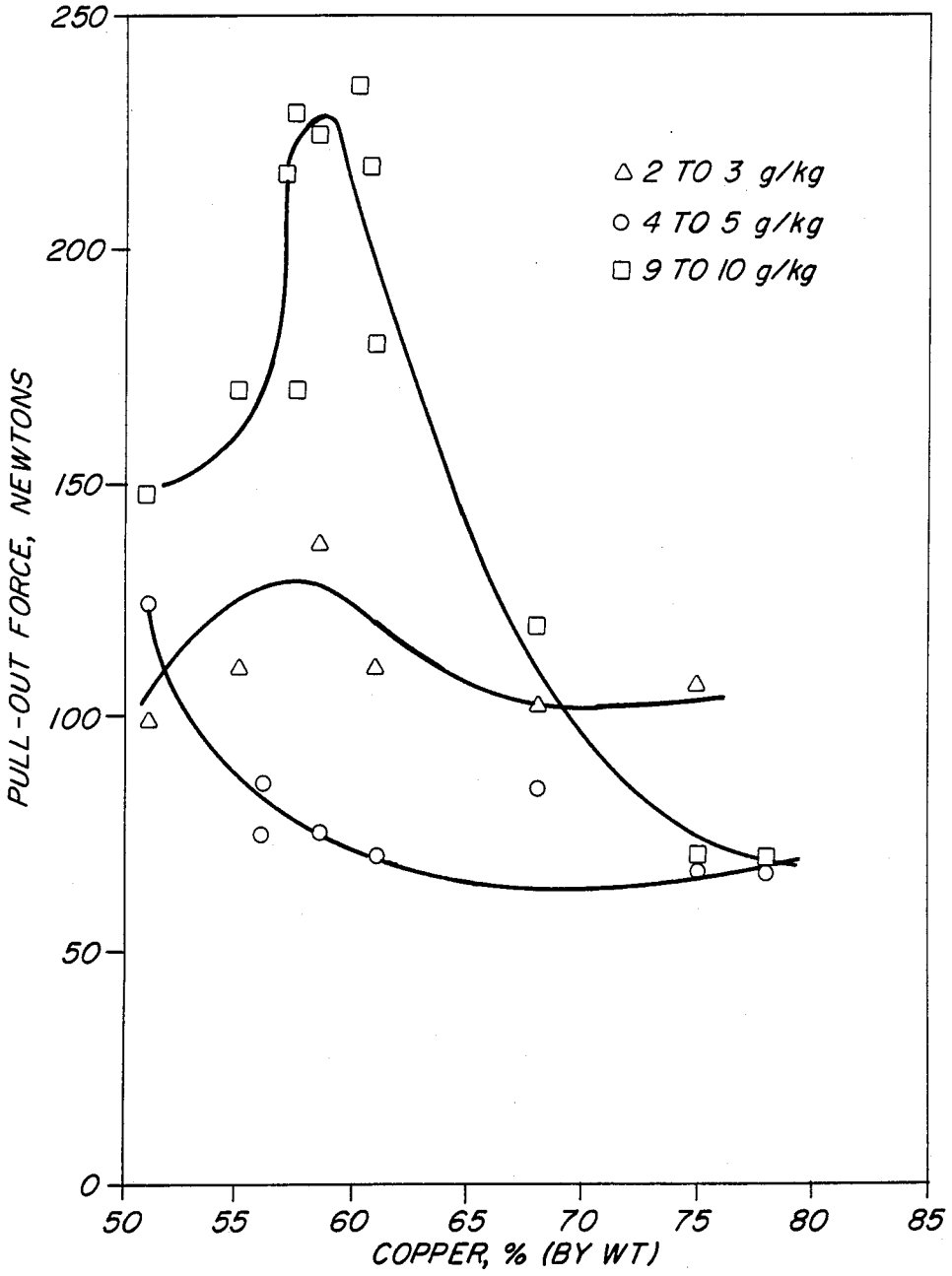
FIG. 6 is a graph showing the effect of copper content in the brass coating and the effect of brass coating weight on cord-to-rubber aged adhesion values of strands imbedded in Goodyear rubber after curing and accelerated aging in stream at 250° F. for 48 hours.

Finally, FIG. 6 shows the results of accelerated aging tests on the cord-to-rubber adhesion values of wire cord embedded in rubber formulation samples of manufacturer A. The aging tests were carried out in accordance with Goodyear Tire and Rubber Company Specification Number FD No. 1 - 15T. The curves show the surprising result that wire having coatings with both lower-than-normal copper content and greater-than-normal thickness had superior aged adhesion values. Coatings having a thickness of 9–10 grams per kilogram of wire have adhesion values in excess of 160 newtons which exceeds the Goodyear specifications. Similar tests carried out on the rubber formulations of various manufacturers indicated an improvement in aged adhesion for some rubber formulations, but no substantial improvement in others. For example, only a modest improvement in adhesion was found for the rubber formulation one of manufacturer while a medium-range improvement intermediate between that of manufacturer A and the one manufacturer was found for the manufacturer B's rubber formulation of manufacturer B.

I claim:

1. A process for producing steel wire for tire-cord by the sequential steps consisting essentially of:

(a) applying a brass-coating to said wire, said coating consisting essentially of from about 54 to about 65% copper and from about 46 to about 35% zinc, the weight of said coating being within the range of from about 2.5 to about 13.0 grams of coating per kilogram of said wire, (b) heating the coated wire to a temperature of at least about 700° F. and not more than a temperature of about 1000° F. for a time sufficient to reduce the hardness of said coating to a value within the range of from about 40 to about 70 on the rockwell B scale, and (c) drawing the heat-treated wire to a final thickness sufficient to provide a reduction in cross-sectional area of at least about 60 percent, said heat treatment serving to significantly improve the drawability of said wire and permit a substantially continuous crack-free coating at the final wire thickness to be achieved.

2. The process of claim 1 wherein the copper content of the coating applied is not more than about 62 percent.

3. The process of claim 1 wherein the reduction in cross-sectional area of said drawing step is at least 80 percent.

4. The process of claim 1 wherein the weight of coating applied to said wire is within the range of from about 80 to about 12.0 grams of coating per kilogram of said wire.

5. The process of claim 1 wherein the copper content of said coating is within the range of from about 56 to 62%, the weight of said coating is within the range of from about 8.0 to about 12.0 grams per kilogram of said wire, and the temperature of said heating step is within the range of from about 700 to about 1000° F.

6. The process of claim 4 wherein the temperature of said heating step is within the range of from about 700° to about 900° F.

7. The process of claim 4 wherein the time of said heating step is sufficient to reduce the hardness of said coating to a value of less than Rockwell B60.

8. The process of claim 5 wherein the weight of said coating is from about 9.0 to about 11.0 grams per kilogram of said wire.

9. A drawn brass coated steel wire product for tire-cord applications consisting essentially of:

a steel wire containing a substantially continuous crack-free outer coating of brass consisting essentially of from about 54 to about 62 percent copper and from about 46 to 38 percent zinc, said coating having a weight within the range of from about 7.0 to about 13.0 grams of coating per kilogram of said wire and a predrawn hardness within the range of from about Rockwell B40 to 70.

10. The product of claim 9 wherein the copper content of said coating is within the range of 56 to 60 percent.

11. The product of claim 9 wherein the weight of said coating is within the range of 9.0 to 11.0 grams of coating per kilogram of wire.

12. The product of claim 9 wherein said wire is in stranded form.

13. A process for producing steel wire for tire-cord by the sequential steps consisting essentially of:

(a) applying a brass-coating to said wire, said coating consisting essentially of from about 54 to about 65% copper and from about 46 to about 35% zinc, the weight of said coating being within the range of from about 2.5 to about 13.0 grams of coating per kilogram of said wire, (b) heating the coated wire to a temperature of at least about 700° F. for a time in the range of about 1.5 minutes to 60 minutes to reduce the hardness of said coating to a value within the range of from about 40 to 70 on the Rockweel B scale and (c) drawing the heat-treated wire to a final thickness sufficient to provide a reduction in cross-sectional area of at least about 60 percent, said heat treatment serving to significantly improve the drawability of said wire and permit a substantially continuous crack-free coating at the final wire thickness to be achieved.

14. A steel wire product for tire-cord applications consisting essentially of:

a steel wire containing a substantially continuous crack free outer coating of brass consisting essentially of from about 54 to about 62% cooper and from about 46 to about 38% zinc, the weight of said coating being within the range of from about 7.0 to about 13.0 grams of coating per kilogram of said wire, said product being produced by annealing the brass coated wire at a temperature of at least about 700° F. and not more than about 1000° F. for a time of at least about 1.5 minutes to reduce the hardness of said brass coating to a value within the range of from about Rockwell B40 to 70 and then drawing the wire to final thickness.

15. A process for improving the aged adhesion properties of steel wire for tire-cord by the sequential steps consisting essentially of (a) applying a brass-coating to said wire, said coating consisting essentially of from about 54 to about 62% copper and from about 38 to about 46% zinc, the weight of said coating being within the range of from about 9.0 to about 11.0 grams of coating per kilogram of said wire, (b) heating the coated wire to a temperature in the range of from about 700 to about 900° F. for at least 5 minutes to reduce the hardness of said coating to a value within the range of from about 40 to about 60 on the Rockwell B scale, and (c) drawing the heat-treated wire to a final thickness sufficient to provide a reduction in cross-sectional area of at least about 60 percent.

* * * * *